United States Patent [19]

Jennings

[11] Patent Number: 4,473,120

[45] Date of Patent: Sep. 25, 1984

[54] METHOD OF RETORTING OIL SHALE USING A GEOTHERMAL RESERVOIR

[75] Inventor: Alfred Jennings, Plano, Tex.

[73] Assignee: Mobil Oil Corporation, New York, N.Y.

[21] Appl. No.: 489,964

[22] Filed: Apr. 29, 1983

[51] Int. Cl.[3] ..... C10B 57/20; E21B 36/00; E21B 43/26

[52] U.S. Cl. ..... 166/302; 60/641.2; 166/266; 166/271; 166/272; 166/281; 166/308; 208/11 R

[58] Field of Search ..... 60/641.1, 641.2; 166/247, 258, 266, 267, 271, 272, 281, 302, 308; 208/11 R; 299/2

[56] References Cited

U.S. PATENT DOCUMENTS

| | | | |
|---|---|---|---|
| 3,066,732 | 12/1962 | McEver | 166/266 |
| 3,091,292 | 5/1963 | Kerr | 166/271 |
| 3,460,867 | 8/1969 | Cameron et al. | 166/272 X |
| 3,858,397 | 1/1975 | Jacoby | 166/302 X |
| 3,960,702 | 6/1976 | Allred | 208/11 R |
| 4,078,904 | 3/1978 | Galt et al. | 60/641.2 X |
| 4,085,795 | 4/1978 | Gill | 60/641.2 X |
| 4,089,373 | 5/1978 | Reynolds et al. | 60/641.2 X |
| 4,140,184 | 2/1979 | Bechtold et al. | 166/266 X |
| 4,234,230 | 11/1980 | Weichman | 299/2 |
| 4,273,615 | 6/1981 | Hirbod | 166/247 X |

FOREIGN PATENT DOCUMENTS

| | | | |
|---|---|---|---|
| 2426870 | 1/1980 | France | 60/641.2 |
| 1071059 | 6/1967 | United Kingdom | 166/247 |

*Primary Examiner*—George A. Suchfield
*Attorney, Agent, or Firm*—Alexander J. McKillop; Michael G. Gilman; Charles A. Malone

[57] ABSTRACT

Crushed raw oil shale is fed into a geothermal compartment or reservoir under oil shale retorting conditions using the reservoir as a source of heat for retorting. After retorting is completed hydrocarbon products are removed from the compartment or reservoir. The resultant spent shale is subsequently used to fill voids in the reservoir. Hydraulic fluids are then placed into the compartment or reservoir and sufficient pressure applied to fracture the reservoir or compartment causing another geothermal compartment or reservoir to be formed.

7 Claims, 2 Drawing Figures

METHOD OF RETORTING OIL SHALE USING A GEOTHERMAL RESERVOIR

BACKGROUND OF THE INVENTION

The present invention relates to the use of heat from geothermal fluids, including steam and brines, and is particularly concerned with steam entering into an underground reservoir into which oil shale is placed and retorted. The geothermal source can be natural or man made (as by atomic explosion underground and/or by injection of water or other heat exchange fluid into an underground reservoir or a deep well and/or by injection of a heat exchange fluid, e.g., water into a spent shale in situ retort).

Various methods are known for utilizing the geothermal steam or brine for electrical power generation. Thus, according to one procedure, the hot geothermal brine is directly flashed and the resulting flashed steam is then expanded through a turbine for electrical generation. According to another mode of procedure, a tube and shell heat exchange apparatus is employed for indirect heat exchange contact between the hot brine on one side and water or a working fluid on the other side, and the heated steam or working fluid is then passed to the turbine for generating power. Such methods are described for example, in Geothermal Energy Utilization by Edward F. Wahl, John Wiley & Sons, New York (1977).

According to a third method, direct contact heat exchange is provided between the geothermal brine and an immiscible (e.g., isobutane) working fluid, and the working fluid is expended through a turbine to produce electrical energy. Illustrations of the latter system are those disclosed in U.S. Pat. No. 3,988,895 to Sheinbaum, application Ser. No. 589,068, filed June 23, 1975, now abandoned by S. F. Woinsky, application Ser. No. 873,264 of E. F. Wahl et al, filed Jan. 30, 1978, now U.S. Pat. No. 4,167,099 and application Ser. No. 50,868 of P. Sadkukhan, filed June 21, 1979, now U.S. Pat. No. 4,272,961 which applications are incorporated herein by reference.

Others have suggested various procedures for replacing spent oil shale materials in the voids formed within the subterranean oil shale deposit. For example, U.S. Pat. No. 3,340,693 suggests mining oil shale and backfilling at least some of the mined out spaces with porous masses of particles through which a suitable reagent is flowed to consolidate the masses. U.S. Pat. No. 3,459,003 suggests mining and retorting oil shale, pumping a slurry containing some of the spent shale into the mine to form a porous mass, thermally converting the remainder of the spent shale to a cement and pumping a slurry of the cement into the mine to fill the pores of the porous mass of spent shale. U.S. Pat. No. 3,588,175 suggests dividing a zone being mined into a number of production levels, mining concurrently on several levels while leaving relatively weak pillars between adjacent stopes, then promptly providing bulkheads and pumping slurries of spent shale into the emptied stopes while removing water to allow the spent shale masses to compact under their own weight.

U.S. Pat. No. 4,081,968 teaches mechanically compacting spent shale to a volume at least substantially as small as that of the in situ volume of the portion of oil shale from which the spent oil shale was obtained. This compacted spent shale is disposed within a mined out portion of the subterranean oil shale.

Still others, due to the problems normally encountered in surface retorting (e.g., cooling and disposal of spent shale), have used in situ retorting of oil shale as a possible means to recover hydrocarbon products from oil shale. Some in situ operations have a retorting zone or gallery formed within the oil shale deposit by first mining out a portion of the shale to create a cavity and then rubblizing the surrounding shale into the cavity by means of explosives or the like. The necessary heat for retorting is then applied to the rubblized shale either by in situ combustion or by circulating externally heated gas therethrough. One such method is taught in U.S. Pat. No. 4,018,280.

SUMMARY OF THE INVENTION

The present invention is directed to a process for obtaining oil products from oil bearing shale by use of a geothermal reservoir comprising placing oil bearing shale into a geothermal reservoir, sealing the opening of the geothermal reservoir; retorting the oil bearing shale under oil shale retorting conditions in the geothermal reservoir for a time sufficient to remove recoverable oil products from the shale; and removing the resultant oil bearing hydrocarbonaceous products from the geothermal reservoir.

Also provided for in the process is a process for retorting and accumulating the spent shale resultant from the in situ geothermal compartment or reservoir retorting of the oil shale until the compartment or reservoir is filled and then applying hydraulic rock fracturing pressure to the reservoir for a time sufficient to cause the compartment or reservoir with retorted shale therein to fracture and form another compartment or geothermal reservoir.

DETAILED DESCRIPTION OF PREFERRED EMBODIMENTS

Figure 2:
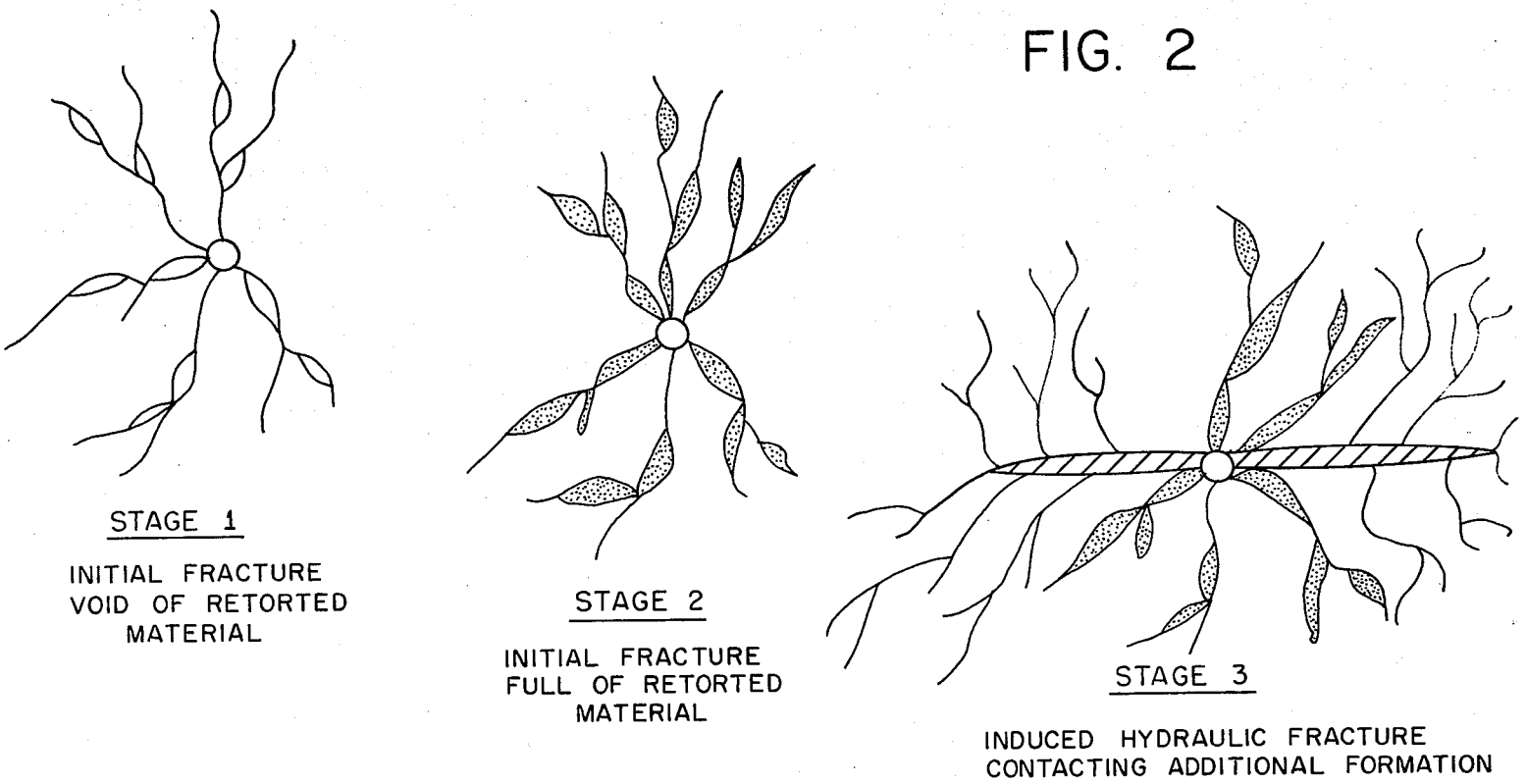
FIG. 2 depicts a possible relationship between the geothermal borehole and the geothermal reservoir containing initial fractures. Various possible stages are depicted in FIG. 2 which indicates how fractures in the reservoir may be filled with spent shale during oil shale retorting and the subsequent fracturing of the reservoir.

A suitable geothermal reservoir is located. Suitable geothermal reservoirs will be permeable enough to allow sufficient steam or water to enter the reservoir. Often a reservoir may be composed of rock formations which cause the reservoir to be compartmentalized. Compartments of the reservoir may be interconnected by natural fracture systems to allow steam or water to flow therebetween. Steam which forms in the reservoir creates a positive pressure beneficial in the oil shale retorting process. Temperatures in a selected reservoir should be at least 315° C. and the natural fracture system such as to facilitate the pumping of an aqueous slurry into the reservoir or a compartment thereof. FIG. 2, Stage 1 is a topical view of one possible fracture system developed in the bottom of a reservoir or a compartment thereof. To obtain a good recovery of hydrocarbonaceous product the fracture is located in a manner as not to cause a loss of the retorted hydrocarbonaceous material.

Figure 1:
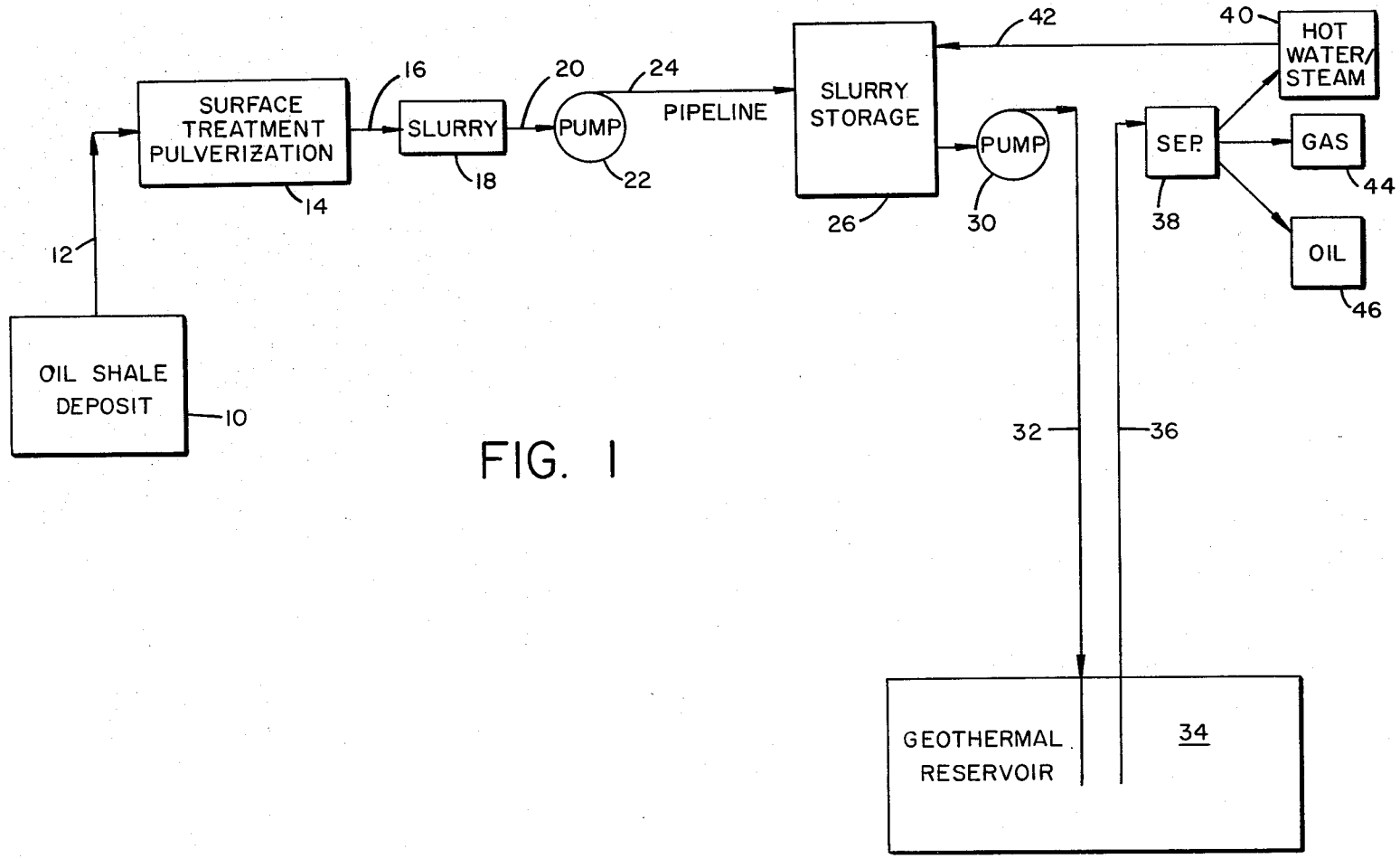
FIG. 1 is a schematic drawing of a geothermal reservoir interconnected with the steps utilized in transferring the oil shale into the reservoir along with steps for the removal of shale oil from the reservoir.

FIG. 1 is a schematic drawing depicting the preferred embodiment of this invention. Oil shale from a deposit (10) is transferred by line (12) into a surface treatment and pulverization means (14). Here the oil shale is pulverized into a size no greater than 0.027 inches or 20/40 mesh U.S. sieve size. Once pulverized, the oil shale is transported via line (16) into tank (18) where it is admixed with water to form a slurry. The slurry is then transferred via line (20) into pump (22) through pipeline (24) into a slurry storage tank (26). Hot water and steam stored in tank (40) is transported via line (42) into the slurry storage tank (26) to preheat the slurry.

The heated slurry is removed from slurry storage tank (26) by a pump means (30) and is pumped through line (32) into the geothermal reservoir (34). Heat and pressure sensing units are placed into the compartment or reservoir and the latter is filled with slurry. When sufficient slurry has been placed into the compartment or reservoir, the compartment or reservoir (34) is closed and retorting is commenced. Allred, U.S. Pat. No. 3,960,702 teaches reactions which may occur when vapor phase water is used in the retorting of oil shale and this patent is hereby incorporated by reference in its entirety.

Depending on the nature of the geothermal compartment or reservoir and oil shale contained in the slurry, the compartment or reservoir is closed for a time sufficient for the desired retorting to occur. Generally, this period will be from about 12 hours to 168 hours. Afterwards, the compartment or reservoir is opened and hydrocarbonaceous fluid pumped therefrom via line (36) to a separator (38). Separator (38) segregates the hydrocarbonaceous fluids into the desired gas (44) and oil components (46).

Once the hydrocarbonaceous fluids have been removed, additional slurry is pumped into the compartment or reservoir, if required, until it becomes uneconomical to pump additional slurry therein. This condition may be caused by the cavity or reservoir becoming filled or when the required pumping pressures become too great. When this occurs hydraulic fracturing pressure is applied through the borehole by means known to those skilled in the art. Pressures applied cause the retorted oil shale particles to become embedded in the natural fractures as shown in FIG. 2, Stage 2 of the drawings, thereby sealing same.

Pressure is applied to the compartment or reservoir until fracturing occurs, and another compartment or reservoir is contacted. The pressures used to induce hydraulic fracturing will usually be from about 1000 psi to about 20,000 psi. A possible fracturing concept is depicted in FIG. 2, Stage 3.

Once fracturing has occurred additional oil shale slurry is pumped into the newly formed compartment or reservoir and retorting thereof is continued.

What is claimed is:

1. A process for obtaining oil products from oil bearing shale using a geothermal steam compartment or reservoir comprising:

(a) placing oil bearing shale into a geothermal steam compartment or reservoir;

(b) sealing the geothermal steam compartment or reservoir opening;

(c) retorting the oil bearing shale under oil shale retorting conditions in the geothermal steam compartment or reservoir for a time sufficient to remove recoverable oil products from the shale; and (d) removing the resultant oil bearing products from the geothermal steam compartment or reservoir.

2. A process as claimed in claim 1 where in step (a) the oil bearing shale is placed into the geothermal compartment or reservoir as a water/oil shale slurry.

3. A process as claimed in claim 2 where in step (a) the oil shale entrained in the slurry is of a particle size of about 0.027 inches or less in diameter.

4. A claim as claimed in claim 1 where in step (c) the retorting of oil shale is conducted at a temperature of from about 315° C. to about 550° C.

5. A process for obtaining oil products from oil bearing shale using a geothermal steam compartment or reservoir comprising:

(a) placing oil bearing shale in slurry form into a geothermal steam compartment or reservoir;

(b) sealing the geothermal steam compartment or reservoir;

(c) retorting the oil bearing shale under oil shale retorting conditions in the geothermal steam compartment or reservoir at a temperature from about 315° C. to about 550° C.;

(d) removing the resultant oil bearing products from the geothermal steam compartment or reservoir;

(e) repeating steps (a) through (d) until the geothermal steam compartment or reservoir is filled with retorted oil shale.

6. A process for obtaining geothermal energy comprising:

(a) placing oil bearing shale in slurry form into a geothermal reservoir or compartment thereof;

(b) sealing the geothermal reservoir or compartment thereof;

(c) retorting the oil bearing shale under oil shale retorting conditions at a temperature of from about 450° C. to about 550° C. in the geothermal reservoir or compartment for a time sufficient to remove recoverable oil products from the shale;

(d) removing the oil bearing products from the geothermal reservoir or compartment;

(e) repeating steps (a) through (d) until the geothermal reservoir or compartment is filled with retorted oil shale; and (f) applying hydraulic rock fracturing pressure to the reservoir or compartment thereof for a time and pressure sufficient to cause the reservoir or compartment to fracture and form another geothermal reservoir or compartment.

7. A claim as claimed in claim 6 where in step (i) the hydraulic rock fracturing pressure is of from about 1000 psi to about 20,000 psi.

* * * * *